US009803423B2

(12) United States Patent
Lauterjung et al.

(10) Patent No.: US 9,803,423 B2
(45) Date of Patent: Oct. 31, 2017

(54) METHOD FOR CONTROLLING AN ARTICULATED TURNTABLE LADDER OF A RESCUE VEHICLE

(71) Applicant: Iveco Magirus AG, Ulm (DE)

(72) Inventors: Christoph Lauterjung, Ulm (DE); Jurgen Zettelmeier, Burlafingen (DE)

(73) Assignee: IVECO MAGIRUS AG, Ulm (DE)

( * ) Notice: Subject to any disclaimer, the term of this patent is extended or adjusted under 35 U.S.C. 154(b) by 31 days.

(21) Appl. No.: 14/514,561

(22) Filed: Oct. 15, 2014

(65) Prior Publication Data

US 2015/0120152 A1 Apr. 30, 2015

(30) Foreign Application Priority Data

Oct. 24, 2013 (EP) ..... 13190067

(51) Int. Cl.
*E06C 5/18* (2006.01)
*E06C 5/04* (2006.01)
*E06C 5/42* (2006.01)

(52) U.S. Cl.
CPC ..... *E06C 5/18* (2013.01); *E06C 5/04* (2013.01); *E06C 5/42* (2013.01)

(58) Field of Classification Search
CPC ..... E06C 5/18; E06C 5/04; E06C 5/42
See application file for complete search history.

(56) References Cited

U.S. PATENT DOCUMENTS 4,775,029 A * 10/1988 MacDonald ..... B66F 11/046 182/2.1
5,819,534 A * 10/1998 Fischer ..... F15B 11/20 182/2.9
2004/0016596 A1* 1/2004 Promersberger ..... B66F 11/044 182/2.9
2005/0189168 A1* 9/2005 Bean ..... B66F 17/006 182/2.8
2011/0042164 A1* 2/2011 Clark ..... B66F 17/006 182/2.2

(Continued)

FOREIGN PATENT DOCUMENTS

DE 9416367 U1 12/1994
DE 4404797 A1 8/1995

(Continued)

*Primary Examiner* — Alvin Chin-Shue
(74) *Attorney, Agent, or Firm* — Stetina Brunda Garred and Brucker

(57) ABSTRACT

The present invention relates to a method for controlling an articulated turntable ladder (12) of a rescue vehicle (10) wherein the ladder (12) comprises a plurality of telescopically extendable ladder parts (14) by including a tip ladder part (18) pivotable around a horizontal first pivot axis (28) by means of a first pivoting drive. The ladder further comprises a cage (22) connected to the free end of the tip ladder part (18) to be pivoted around a second pivot axis (30) by means of a second pivoting drive. The ladder (12) is pivotably mounted to a base part (16) on top of the vehicle (10) by means of a third pivoting drive to be lifted or lowered around a third pivot axis (32). The method provides for the step of controlling the first pivoting drive such that the absolute inclination angle (α) of the tip ladder part (18) is maintained constant during a lifting or lowering movement of the ladder (12) around the third pivot axis (32).

7 Claims, 3 Drawing Sheets

(56) References Cited

U.S. PATENT DOCUMENTS

| | | | | | |
|---|---|---|---|---|---|
| 2015/0307337 | A1* | 10/2015 | Ewert | ..... | B66F 11/046<br>182/2.4 |

FOREIGN PATENT DOCUMENTS

| | | | | | |
|---|---|---|---|---|---|
| DE | EP 2022749 | A1 * | 2/2009 | ..... | B66F 11/046 |
| EP | 1048605 | A1 | 11/2000 | | |
| EP | 1088960 | A2 | 4/2001 | | |
| EP | 2404862 | A1 | 1/2012 | | |

* cited by examiner

METHOD FOR CONTROLLING AN ARTICULATED TURNTABLE LADDER OF A RESCUE VEHICLE

CROSS REFERENCE TO RELATED APPLICATIONS

The present application claims priority to European Patent Priority No. 13190067.2 filed Oct. 24, 2013, the entirety of the disclosures of which are expressly incorporated herein by reference.

STATEMENT RE: FEDERALLY SPONSORED RESEARCH/DEVELOPMENT

Not Applicable.

APPLICATION FIELD OF THE INVENTION

The present invention is related to a method for controlling an articulated turntable ladder of a rescue vehicle, and to a corresponding articulated turntable ladder, comprising a control device.

DESCRIPTION OF THE PRIOR ART

Articulated turntable ladders are very common as rescue ladders on fire engines or other rescue vehicles. Such ladders comprise a plurality of ladder parts or segments that can be extended or retracted with respect to each other to extend or to shorten the overall length of the ladder, to adapt it to different rescue heights. At the end of the ladder, a cage is mounted to be entered by a rescue person, for example, by a fire fighter.

Modern turntable ladders of this kind comprise a tip ladder part at their end that is connected to the remaining ladder parts to be pivoted around a horizontal axis by means of a pivoting drive, such that the tip ladder part, carrying the cage, can be articulated in an upward or downward direction by operating the pivoting drive. By means of this articulation motion, there is a higher degree of freedom for positioning the cage. For example, the cage can be positioned in a low position by tilting the tip ladder part downwardly, to reach an underfloor rescue position. The ladder as such is pivotably mounted to a base part on top of the vehicle, to be lifted or lowered around another pivot axis by means of another pivoting drive. The cage itself can be pivoted with respect to the tip ladder part by means of still another pivoting drive. In the following description, the axis for pivoting the tip ladder part with respect to the remaining ladder parts will be referred to as first pivot axis, being provided with a first pivoting drive, while the pivot axis between the cage and the tip ladder part will be referred to as second pivot axis, provided with a second pivot in drive, while the ladder as such can be lifted or lowered at the basis around a third pivot axis, provided with a third pivoting drive. The second pivot axis and the third pivot axis are parallel to the first pivot axis, which extends horizontally to the ground, at least in a situation in which the vehicle is standing on a flat ground. For the present invention, deviations from the horizontal position of the first pivot axis are tolerated, especially in rescue situations in which the vehicle is slightly tilted. As commonly known, the base part can also be turned around a vertical pivot axis.

Although the provision of the tip ladder part, which can be articulated with respect to the remaining ladder parts, gives a large degree of freedom in positioning the cage, the control of the ladder becomes very complex, especially in rescue situations with poor sight and visibility and in narrow spaces, especially when the rescue vehicle is positioned in a narrow street or alley. To guide the cage on a desired trajectory, the first, second and third pivoting drive must be operated at the same time. For example, if the ladder is lifted at its base part, the absolute orientation of the cage must be maintained by compensating the lifting movement around the third pivot axis by operating the second pivoting drive in the opposite direction to the same extend.

Moreover, it becomes at least the same important to control the absolute position of the tip ladder part. To achieve the lowest possible outreach of the ladder with a very small rescue height, the tip ladder part should be articulated downwardly in its maximum downward tilting position. However, this tilting movement is limited by the position in which the cage can be still maintained in a position with the cage floor being positioned horizontally. With other words, the maximum inclination angle of the tip ladder part also depends on the position of the cage. The tip ladder part can only be lowered further if the ladder as such is elevated at the same time. Obviously this results in a very complex movement pattern.

Moreover, there are other situations in which the outreach of the ladder needs to be controlled differently. For example, there are rescue situations in which the outreach of the ladder shall be kept at a maximum. In another situation, the ladder shall be controlled to reach its maximum rescue height. Because of the large degree of freedom of the different ladder parts, manual control of the ladder is difficult and demanding.

SUMMARY OF THE INVENTION

It is therefore an object of the present invention to facilitate the operation of an articulated turntable ladder of the above kind, in particular to facilitate the operation of the ladder, corresponding to the minimum outreach with a small rescue height, a maximum outreach and the maximum rescue height.

This object is achieved by a method comprising the features described herein, and by an articulated turntable ladder comprising the features described herein.

According to the method of the present invention, the first pivoting drive at the first pivot axis between the tip ladder part and the remaining ladder parts is controlled by means of a control device such that the absolute inclination angle of the tip ladder part is maintained constant automatically during a lifting or lowering movement of the ladder around the third pivot axis. This means that if the operator inputs a command to lift the ladder, including all ladder segments, by pivoting it around the third pivot axis, the inclination angle of the tip ladder part is compensated such that its absolute inclination angle is maintained constant. With other words, if the ladder as such is lifted to a certain extend, the tip ladder part at the end of the ladder is lowered to the same extend for compensation, to keep the absolute spatial orientation of the tip ladder part.

If it is desired to operate the ladder with the lowest possible outreach and small rescue height, the operator can control the articulated turntable ladder accordingly by selecting a respective mode. The tip ladder part will then be articulated to its maximum downward inclination angle. In this position, the operator can lift or lower the complete ladder into any desired rescue height, while the absolute inclination angle of the tip ladder part is still maintained constant. With other words, there is no further need to compensate the angular position of the tip ladder part manually during positioning the cage in a complex movement, because the method according to the present invention provides an automatic compensation if the absolute inclination angle of the tip ladder part is selected once.

According to the same operation principle, the operator can select a mode to position the ladder with its maximum outreach. In this case the absolute inclination angle of the tip ladder part corresponds to its horizontal position over the ground. This position will be maintained in any lifting or lowering movement of the ladder. As a third example, if it is desired to keep the maximum rescue height, the tip ladder part will be positioned in its maximum elevation angle at any time.

According to one preferred embodiment of the present invention, the second pivoting drive is controlled such that the absolute orientation of the cage is maintained constant during a lifting or lowering movement of the ladder around the third pivot axis. More preferably, the absolute inclination angle of the tip ladder part is selected from a plurality of different absolute inclination angles upon a user input command. These inclination angles correspond different modes of the ladder operation, as described above, i.e. lowest outreach, maximum outreach or maximum rescue height.

According to another preferred embodiment of the present invention, the plurality of different absolute inclination angles comprises at least one of the following: a maximum downward inclination angle of the tip ladder part, a maximum elevation angle of the tip ladder part, and a horizontal angle in which the tip ladder part is held in a horizontal position.

Preferably, upon generation of a lifting or lowering command, the ladder is lifted or lowered by operating the third pivoting drive in the respective direction, while the first pivoting drive is operated in the opposite direction.

More preferably, the position of the tip ladder part is monitored by means of sensors. This provides the option to control the end position of the ladder part, after or during the compensation movement of the third pivoting drive with respect to the first pivoting drive.

It is further preferred that at the end of a lifting or lowering movement of the ladder around the third pivot axis, the absolute position of the tip ladder part and/or the cage is adjusted. This can be performed with the help of the sensors, as described before, controlling the position of the tip ladder part and/or the cage.

The present invention further refers to an articulated turntable ladder of a rescue vehicle, comprising a plurality of telescopically extendable ladder parts including a tip ladder part that is connected to the remaining ladder parts to be pivoted around the horizontal first pivot axis by means of the first pivoting drive, and a cage connected to the free end of the tip ladder part to be pivoted around a second pivot axis by means of a second pivoting drive, said ladder being pivotably mounted to a base part on top of the vehicle by means of a third pivoting drive to be lifted or lowered around a third pivot axis, said second pivot axis and said third pivot axis being parallel to said first pivot axis, and a control device for controlling the movement of the ladder, comprising means for generating control commands for operating the first pivoting drive, the second pivoting drive and the third pivoting drive, respectively, wherein the control device is provided for controlling the first pivoting drive such that the absolute inclination angle of the tip ladder part is maintained constant during a lifting or lowering movement of the ladder around the third pivot axis.

Preferably, the control device is provided for maintaining the absolute orientation of a cage constant during a lifting or lowering movement of the ladder around the third pivot axis.

More preferably, a plurality of different absolute inclination angles of the tip ladder part is stored within the control device, from which one absolute inclination angle is selectable upon a user input command.

More preferably, the plurality of different absolute inclination angles comprises at least one of the following: a maximum downward inclination angle of the tip ladder part, a maximum elevation angle of the tip ladder part, and a horizontal angle in which the tip ladder part is held in a horizontal position.

According the preferred embodiment, the control device is provided to generate a control command for operating the third pivoting drive in one direction to lift or to lower the ladder, respectively, upon reception of a lifting or lowering input command, and to generate a control command for operating the first pivoting drive in the opposite direction.

More preferably, the articulated turntable ladder according to the present invention comprises sensors for monitoring the position of the tip ladder part.

Preferably the control device is provided for adjusting the absolute position of the tip ladder part and/or the cage at the end of a lifting or lowering movement of the ladder around the third pivot axis.

BRIEF DESCRIPTION OF THE FIGURES

A preferred example of an embodiment of the present invention will be described in more detail below, with reference to the enclosed drawings, as follows.

DETAILED DESCRIPTION OF PREFERRED EMBODIMENTS OF THE INVENTION

Figure 1:
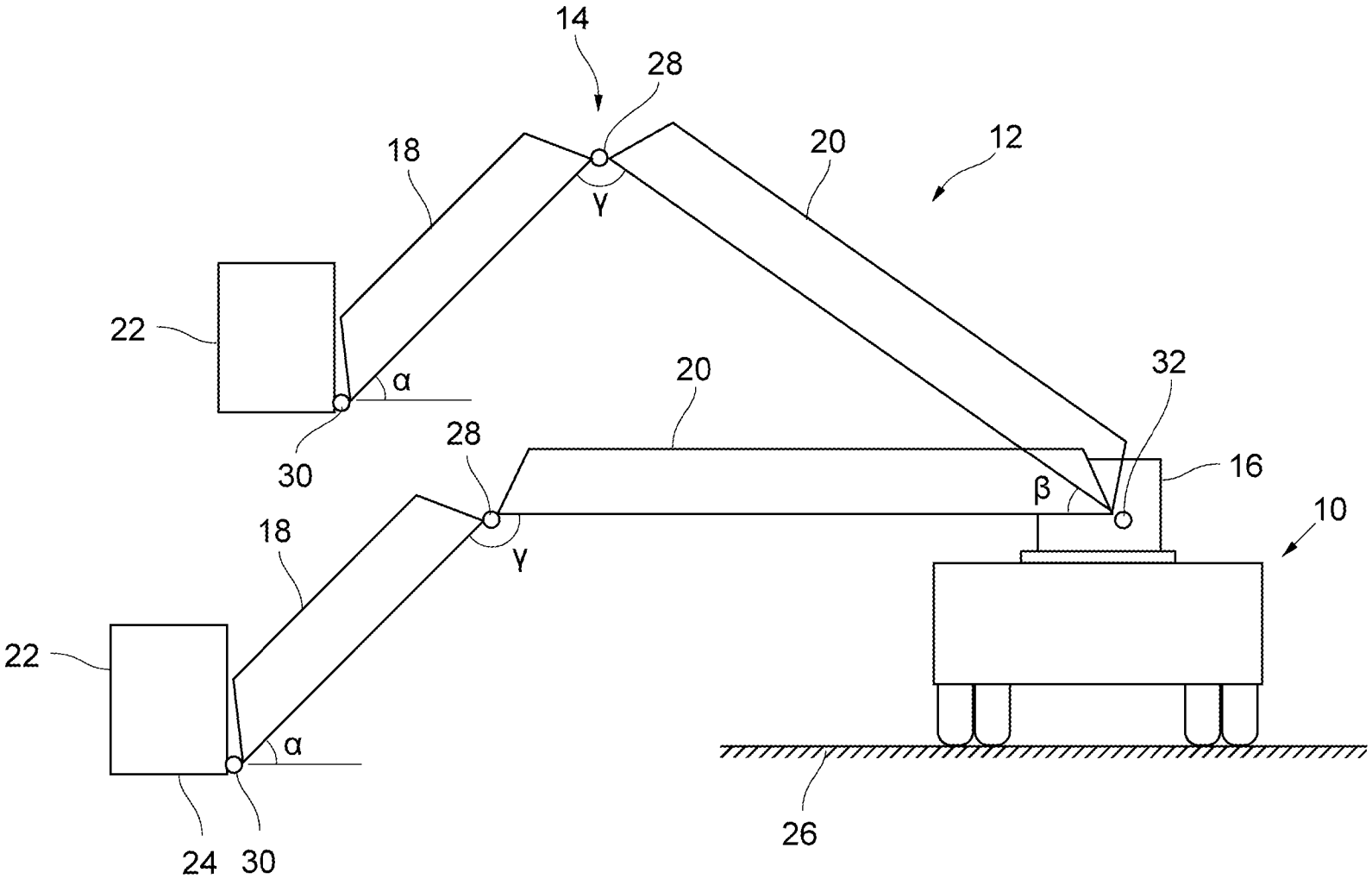
FIGS. 1 to 3 are schematic views of a rescue vehicle comprising an articulated turntable ladder according to the present invention in operation, each figure referring to a different operation mode.

The rescue vehicle 10 in FIG. 1 is equipped with an articulated turntable ladder 12 on top. This articulated turntable ladder (also referred to as "ladder" 12 in the following for the sake of simplicity) comprises a plurality of telescopically extendable ladder parts 14 that are articulated to a base part 16 on top of the vehicle 10, so that the ladder 12 can be lifted or lowered. While all ladder parts 14 are slidably connected to each other so that they can be extended or retracted, a tip ladder part 18 is connected to the remaining ladder parts 20 to be articulated or pivoted around a pivot axis connecting a tip ladder part 18 and the remaining ladder parts 20. At the free end of the tip ladder part 18 (on the left side in FIG. 1), a cage 22 is mounted to be pivoted around another pivot axis. It is further noted that the base part 16 can be turned on top of the vehicle 10 around a vertical turning axis.

This articulated turntable ladder 12 has a large degree of freedom for positioning the cage 22, because of the vertical turning axis of the base part 16, the option of lifting or lowering the ladder parts 14, telescopically extending or retracting the ladder parts 14 from each other, articulating the tip ladder part 18 with respect to the remaining ladder parts 20, while keeping the absolute orientation of the cage 22 so that its bottom 24 is maintained in a constant horizontal position above the ground 26. In all examples described herein, the ground 26 is a flat horizontal plane.

In the following, the pivot axis between the tip ladder part 18 and the remaining ladder parts 20 is designated as first pivot axis 28, a pivot axis connecting the cage 22 to the tip ladder part 18 is designated as second pivot axis 30, and the pivot axis for lifting or lowering the ladder 12 at the base part 18 is designated as third pivot axis 32. The first pivot axis 28 is horizontal, while the second pivot axis 30 and the third pivot axis 32 are also horizontal and parallel to the first pivot axis 28. Each pivot axis 28, 30, 32 is equipped with a corresponding pivoting drive, namely a first pivoting drive for the first pivot axis 28, a second pivoting drive for the second pivot axis 30 and a third pivoting drive for the third pivot axis 32. The pivoting drives are not shown in the figures. By operating one of these pivoting drives, the two elements connected by the respective pivot axis are articulated with respect to each other, i.e. they change their angling position. For example, by operating the third pivoting drive, the ladder 12 is lifted or lowered with respect to the vehicle 10 so that the ladder parts 14 change their angling position with respect to the horizontal ground 26. In the same way, an operation of the first pivoting drive changes the angle between the tip ladder part 18 and the remaining ladder parts 20. The second pivoting drive mainly serves to keep the orientation of the cage 22, as described above, to compensate a change of the absolute inclination angle of the tip ladder part 18. The first pivoting drive, the second pivoting drive and the third pivoting drive are controlled by a control device that generates control commands.

The lower position of the ladder 12 in FIG. 1 designates a position in which the ladder 12 as its lowest possible outreach at an underfloor rescue height, with the remaining ladder parts 20 (with exception of the tip ladder part 18) being positioned horizontally. In this situation the tip ladder part 18 is articulated downwardly, with an inclination angle $\alpha$ with respect to the horizontal plane (i.e. the ground 26) of about 45 degrees. In many rescue situations, a very low outreach of the ladder 12 with a small rescue height is desired. Instead of controlling the pivoting drives for all free pivot axis 28, 30, 32 manually by an operator at the base part 16, as it is known from the state of the art, the articulated turntable ladder 12 according to the present invention provides to keep the absolute inclination angle $\alpha$ of the tip ladder part 18 constant in a determined operation mode during all movements of the ladder 12. For example, if a designated operation mode is selected by the operator, for example, the mode of lowest outreach of the ladder, as shown in FIG. 1, the tip ladder part 18 is automatically driven to keep the absolute inclination angle $\alpha$ as shown, and during all further movements of the ladder, this inclination angle $\alpha$ is maintained. Each inclination angle $\alpha$ corresponds to one selectable mode and is pre-stored in a memory of the control device.

For example, if the third pivoting drive is operated to lift the ladder 12 at the base part 16 and to increase the inclination angle $\beta$ of the remaining ladder parts 20, the first pivoting drive is operated to decrease the angle $\gamma$ between the tip ladder part 18 and the remaining ladder parts 20 at the first pivot axis 28 to compensate this increase of the inclination angle $\beta$ and to keep the absolute inclination angle $\alpha$ of the tip ladder part 18 constant. This is performed automatically by the control device that controls the operation of the first pivoting drive at the pivot axis 28 such that the angle $\alpha$ is constant during a lifting or lowering movement of the ladder 12 around the third pivot axis 32. During this movement, the second pivoting drive is also operated such that the absolute orientation of the cage 22 is maintained constant.

The mode of lowest outreach, demonstrated in FIG. 1, is only one of different possible modes that can be selected by an operator. Once the mode is chosen, the absolute inclination angle $\alpha$ of the tip ladder part 18 is adjusted by the control device, and during the further positioning of the cage 22 in a rescue situation, the operator only needs to control the overall inclination angle of the ladder 12, i.e. the articulation around the third pivot axis 32 at the base part 16 manually, to turn the ladder 12 around its vertical axis, and to extract or retract the ladder part 14 from each other. There is no need to adjust the absolute inclination angle $\alpha$ of the tip ladder part 18 manually. This simplifies the operation of the ladder 12. In practice, upon generation of a lifting or lowering command input by the operator, the ladder 12 is lifted or lowered by operating the third pivoting drive in a respective direction, while the first pivoting drive is operated in the opposite direction to perform the compensation of this movement to keep the absolute inclination angle $\alpha$.

This compensation by operating the first pivoting drive and the third pivoting drive at the same time can be supplemented by monitoring the position of the tip ladder part 18 by means of sensors that measure the inclination of the tip ladder part 18. If there is a deviation from the desired inclination angle, the sensors give a corresponding correction signal to the control device so that the first pivoting drive can be operated accordingly to perform this correction and to keep the absolute inclination angle $\alpha$ as desired. With other words, there is a feedback about the present inclination angle. In one embodiment, the absolute position of the tip ladder part 18 and/or the cage 22 is adjusted at the end of a lifting or lowering movement of the ladder 12 around the third pivot axis 32.

Figure 2:
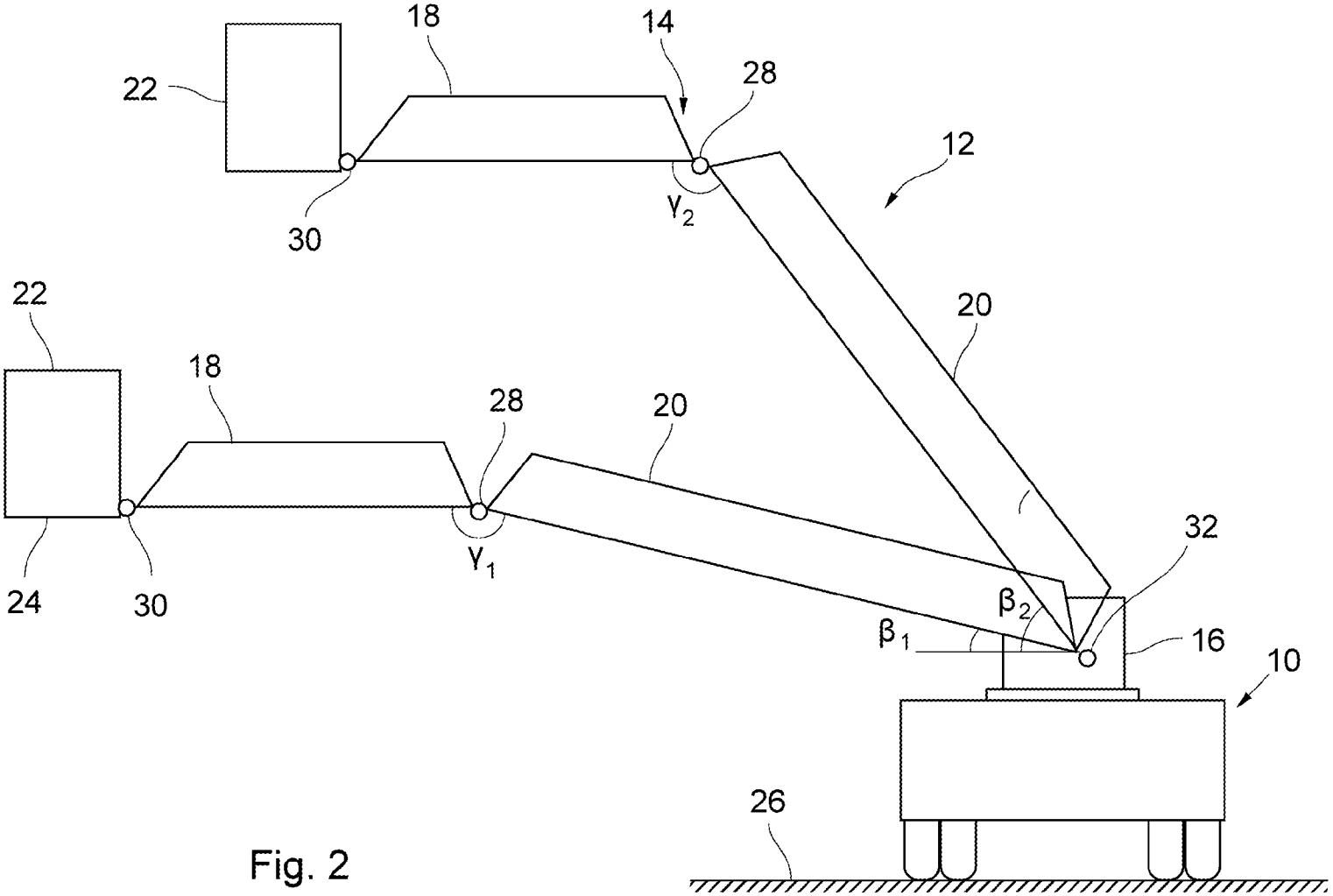

FIG. 2 shows the articulated turntable ladder 12 that has been described above in connection with FIG. 1 in a different operation mode, corresponding to the different absolute inclination angle $\alpha$ of the tip ladder part 18. In FIG. 2, the tip ladder part 18 is maintained in a horizontal position, i.e. the absolute inclination angle $\alpha=0$. Two different elevation angles of the ladder 12 with respect to the base part 16 are shown, corresponding to inclination angles $\beta_1$ and $\beta_2$, with $\beta_2>\beta_1$. To keep $\alpha=0$ in each of these positions, the angle $\gamma_2$ in the position of $\beta_2$, i.e. the angle between the remaining ladder parts 20 and the tip ladder part 18, must be smaller than the angle $\gamma_1$ in the situation with $\beta_1$. As described above, a corresponding mode with an absolute inclination angle $\alpha$ of the tip ladder part 18 can be selected by the operator. The mode in FIG. 2, with the tip ladder part 18 being in a horizontal position, with $\alpha=0$, corresponds to the maximum outreach of the ladder 12, which can be desired in some rescue situations. It is also noted that with the remaining ladder parts 20 all retracted and the tip ladder part 18 being maintained horizontal, the center of gravity of the rescue vehicle 10 including the ladder 12 is still close to the base part 16, compared with a situation in which at least some of the remaining ladder parts 20 are extracted, shifting the center of gravity side ways from the vehicle 10. This is one reason why choosing the mode shown in FIG. 2 can be desired. Keeping the tip ladder part 18 in its horizontal position is performed in the same way as described in connection with FIG. 1, i.e. by compensating the lifting or lowering movement of the ladder 12 around the third pivot axis 32 by controlling a first pivoting drive 28 by means of the control device, so that no manual adjustment of the absolute inclination angle $\alpha$ of the tip ladder part 18 being necessary.

Figure 3:
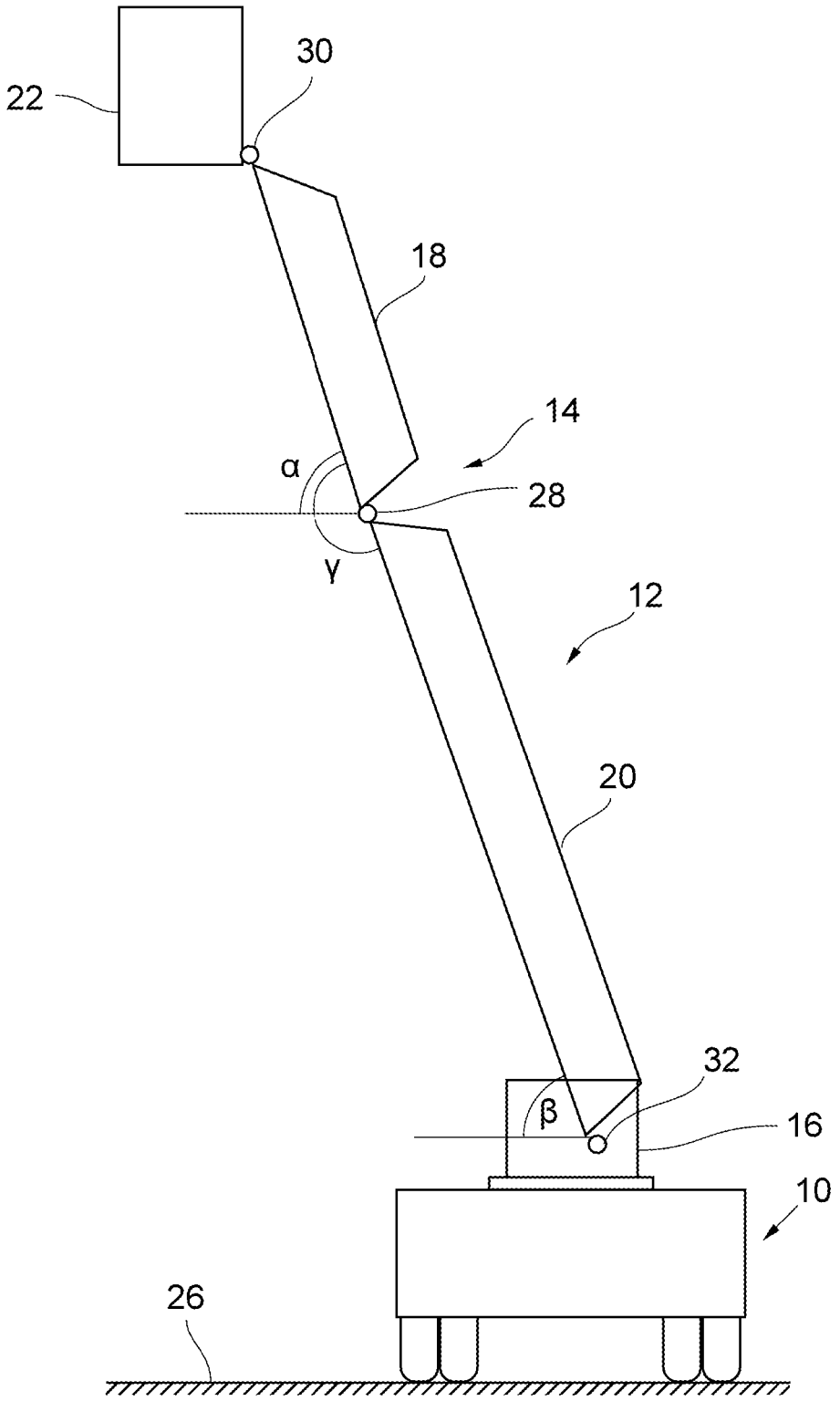

A third mode that can be selected by the operator is demonstrated in FIG. 3, representing the maximum possible rescue height of the ladder 12. In this position the inclination angle α of the tip ladder part 18 is maximal. Together with moving the tip ladder part 18 into this maximum elevation position, the inclination angle β of the remaining ladder parts 20 can also be moved automatically into its maximum position when the mode of maximum rescue height is selected by the operator. During any further movement of the ladder 12, the maximum inclination angle α of the tip ladder part 18 is maintained constant automatically.

The invention claimed is:

1. A method for controlling an articulated turntable ladder of a rescue vehicle, said ladder comprising a plurality of telescopically extendable ladder parts including a tip ladder part that is connected to one or more other ladder parts of the plurality of telescopically extendable ladder parts to be pivoted around a horizontal first pivot axis by means of a first pivoting drive, a cage being connected to a free end of the tip ladder part to be pivoted around a second pivot axis by means of a second pivoting drive, said ladder being pivotably mounted to a base part on top of the vehicle by means of a third pivoting drive to be lifted or lowered around a third pivot axis, said second pivot axis and said third pivot axis being parallel to said first pivot axis, the method comprising:

controlling the first pivoting drive such that an absolute inclination angle of the tip ladder part is maintained constant during a lifting or lowering movement of the ladder around the third pivot axis, the absolute inclination angle of the tip ladder part being selected from a set of predetermined absolute inclination angles upon a user input command.

2. The method according to claim 1, further comprising controlling the second pivoting drive such that an absolute orientation of the cage is maintained constant during a lifting or lowering movement of the ladder around the third pivot axis.

3. The method according to claim 1, characterized in that the plurality of different absolute inclination angles comprises at least one of a maximum downward inclination angle of the tip ladder part, a maximum elevation angle of the tip ladder part, and a horizontal angle in which the tip ladder part is held in a horizontal position.

4. The method according to claim 1, characterized in that upon generation of a lifting or lowering command, the ladder is lifted or lowered by operating the third pivoting drive in a first direction, while the first pivoting drive is operated in a second direction opposite to the first direction.

5. The method according to claim 1, characterized in that a position of the tip ladder part is monitored by means of sensors.

6. The method according to claim 1, characterized in that at the end of a lifting or lowering movement of the ladder around the third pivot axis, an absolute position of the tip ladder part and/or the cage is adjusted.

7. A method for controlling an articulated turntable ladder of a rescue vehicle, said ladder comprising a plurality of telescopically extendable ladder parts including a tip ladder part that is connected to one or more other ladder parts of the plurality of telescopically extendable ladder parts to be pivoted around a horizontal first pivot axis by means of a first pivoting drive, a cage being connected to a free end of the tip ladder part to be pivoted around a second pivot axis by means of a second pivoting drive, said ladder being pivotably mounted to a base part on top of the vehicle by means of a third pivoting drive to be lifted or lowered around a third pivot axis, said second pivot axis and said third pivot axis being parallel to said first pivot axis, the method comprising:

controlling the first pivoting drive such that an absolute inclination angle of the tip ladder part is maintained constant during a lifting or lowering movement of the ladder around the third pivot axis; and controlling the second pivoting drive such that an absolute orientation of the cage is maintained constant during a lifting or lowering movement of the ladder around the third pivot axis;

wherein the absolute inclination angle of the tip ladder part is selected from a set of predetermined absolute inclination angles upon a user input command.

* * * * *